United States Patent [19]

Chelminski

[11] Patent Number: 4,596,231

[45] Date of Patent: Jun. 24, 1986

[54] SELF-CLEANING, HIGH HEAT EXCHANGE WOOD OR COAL STOVE

[76] Inventor: Stephen V. Chelminski, 63 Side Cut Rd., West Redding, Conn. 06896

[21] Appl. No.: 671,563

[22] Filed: Nov. 15, 1984

[51] Int. Cl.[4] ..... F24B 3/00

[52] U.S. Cl. ..... 126/67; 126/181; 126/149; 126/72; 110/276

[58] Field of Search ..... 126/67, 149, 144, 152 R, 126/152 B, 181, 169, 70, 71, 72, 61, 126, 123; 110/276, 327

[56] References Cited

U.S. PATENT DOCUMENTS 342,809 6/1886 Poore ..... 126/181

455,613 7/1891 Forbes ..... 126/149 X

FOREIGN PATENT DOCUMENTS 372429 5/1932 United Kingdom ..... 110/276

*Primary Examiner*—Larry Jones

*Attorney, Agent, or Firm*—Parmelee, Bollinger & Bramblett

[57] ABSTRACT

A self-cleaning, high heat transfer wood or coal stove includes an interior cylindrical squirrel-cage configured fuel grate comprised of parallel air-conducting pipes for heating forced cold air. This arrangement of pipes not only provides for a self-cleaning stove interior due to the cyclical condensation and combustion of deposited effluents produced by combustion, but also greatly enhances the heat transfer capability of the stove by increasing the surface area available for heat exchange. The cyclical condensation and combustion is effected by incrementally rotating the interior cylindrical fuel grate by turning, using a handle inserted into one of a plurality of rod sockets which reside on the front of the stove. The stove of this invention is constructed with separate doors for convenient fuel loading and ash removal, and the fuel loading door is disposed to engage the combustion chamber opening with an air-tight and secure fit. The compact and efficient construction further provides a versatile stove capable of heating a relatively large volume of living space in proportion to its relatively small size.

21 Claims, 4 Drawing Figures

SELF-CLEANING, HIGH HEAT EXCHANGE WOOD OR COAL STOVE

BACKGROUND OF THE INVENTION

This invention relates to apparatus for heating such as coal and wood burning stoves.

The formation of layers of creosote on the interior surfaces of stoves and chimney flues has long plagued users of wood and coal stoves. This oily, sticky, tar-like substance results from the burning of wood or coal and is deposited wherever such gaseous combustion effluents are exposed to surfaces cooler than the vaporization temperature of creosote. This highly flammable residue usually forms in passageways and on interior walls of flues above the area of combustion, since those areas are generally cool enough for upwardly moving, draft-borne creosote gases to condense upon them. Every year, a great number of individuals suffer losses due to fires caused by a dangerous build-up and ignition of creosote within such flues. Periodic cleaning of these creosote deposits to ensure against these fires is a costly, tedious, and messy task. In addition, wood and coal stoves which are currently commercially available, often require large combustion chambers and accordingly, large quantities of wood or coal in order to heat typical living quarters. This drawback is caused by the limited and inefficient exchange of heat energy from the burning fuel to the ambient air in the room. The housing of such a stove has limited surface area for delivery of heat to the surrounding air and therefore, must consume large quantities of fuel in order to be effective for space heating purposes.

Accordingly, it is an object of the present invention to provide a wood or coal stove for which such troublesome cleaning chores are reduced, and the risk of such dangerous fires are greatly diminished by the incorporation of means for self-cleaning removal of undesirable creosote layers during the operation of the stove.

It is a further object of the invention to provide a compact, efficient, and high heat exchange wood or coal stove which consumes relatively little fuel and occupies less space than conventional stoves in relation to the amount of heat which is supplied for space heating.

SUMMARY OF THE INVENTION

In accordance with these objects of the invention, a stove is provided which may use wood, coal, or other fuels and which is adapted to automatically self-clean away the deposits of creosote layers from interior surfaces of the stove in order to prevent dangerous fires. Also, the air-conducting (air-cooled) pipes or tubes which become positioned above the fire, serve to condense and collect creosote for preventing its later deposit in the flue or chimney. This creosote-condensing removal advantage is obtained by employing a barrel or squirrel-cage-like assembly of air-conducting pipes or tubes mounted between end plates which are revolvable. These pipes extend longitudinally within the stove housing and are disposed as a group to receive and support fuel for combustion, the fuel being introduced through the front end of the stove. This cylindrical squirrel-cage arrangement of tubes acts as a grate for holding burning fuel and for allowing ash material to fall between the tubes to an ash chamber below. When this squirrel-cage array of tubes is rotated about its longitudinal axis, hot tubes at the bottom of the combustion chamber directly beneath and adjacent to the burning fuel are thus revolved away from the hottest region in the chamber toward the top of the chamber. There the previously hot tubes become cooled by forced air flow through them, and rising, gaseous creosote condenses out upon their cooled surfaces.

When the squirrel-cage assembly is rotated further, the respective positions of the hot and cooled tubes is reversed. Consequently the creosote which was deposited on the uppermost tubes is then volatilized by being adjacent to the combustion, and much of it becomes consumed by burning as it rises through the hot flames.

Yet another advantageous feature of this novel stove is achieved through the improved heat exchange capability made possible by the conductance of forced, cold air from outside the stove through these tubes. As the forced air travels through the conduction passages within the tubes, the ambient air becomes heated to a greater extent than would be possible by radiation from the exterior surface of the stove housing alone. For example, the illustrative embodiment of the invention disclosed has at least twice the heat exchange surface area as compared with a stove having just an outer housing. This increased surface area available for the transmission of heat greatly improves the fuel efficiency of the stove The tight seal formed between the fuel loading door and the combustion chamber prevents undesired leakage of combustion air through the chamber area, thereby enabling the rate of combusion to be controlled by an adjustable combustion air inlet.

BRIEF DESCRIPTION OF THE DRAWINGS

Other features, objects, aspects and advantages of this invention will be explained and a more complete understanding of the invention will be appreciated from considering the accompanying drawings in conjunction with the following detailed description.

DESCRIPTION OF THE PREFERRED EMBODIMENTS

Figure 1:
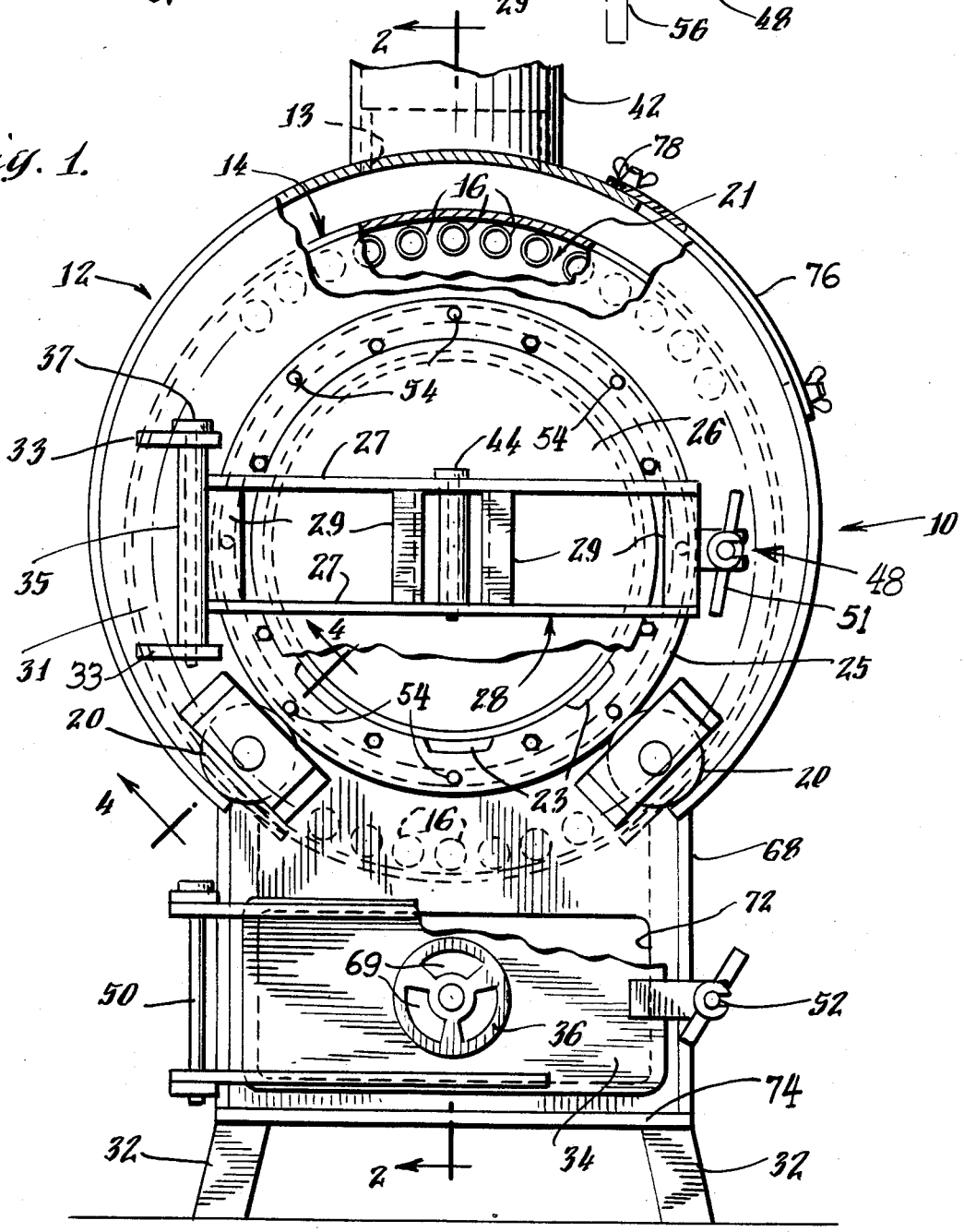
FIG. 1 is a front elevational view, which is partially cut away, showing a wood or coal stove embodying the invention.
Figures 2, 4:
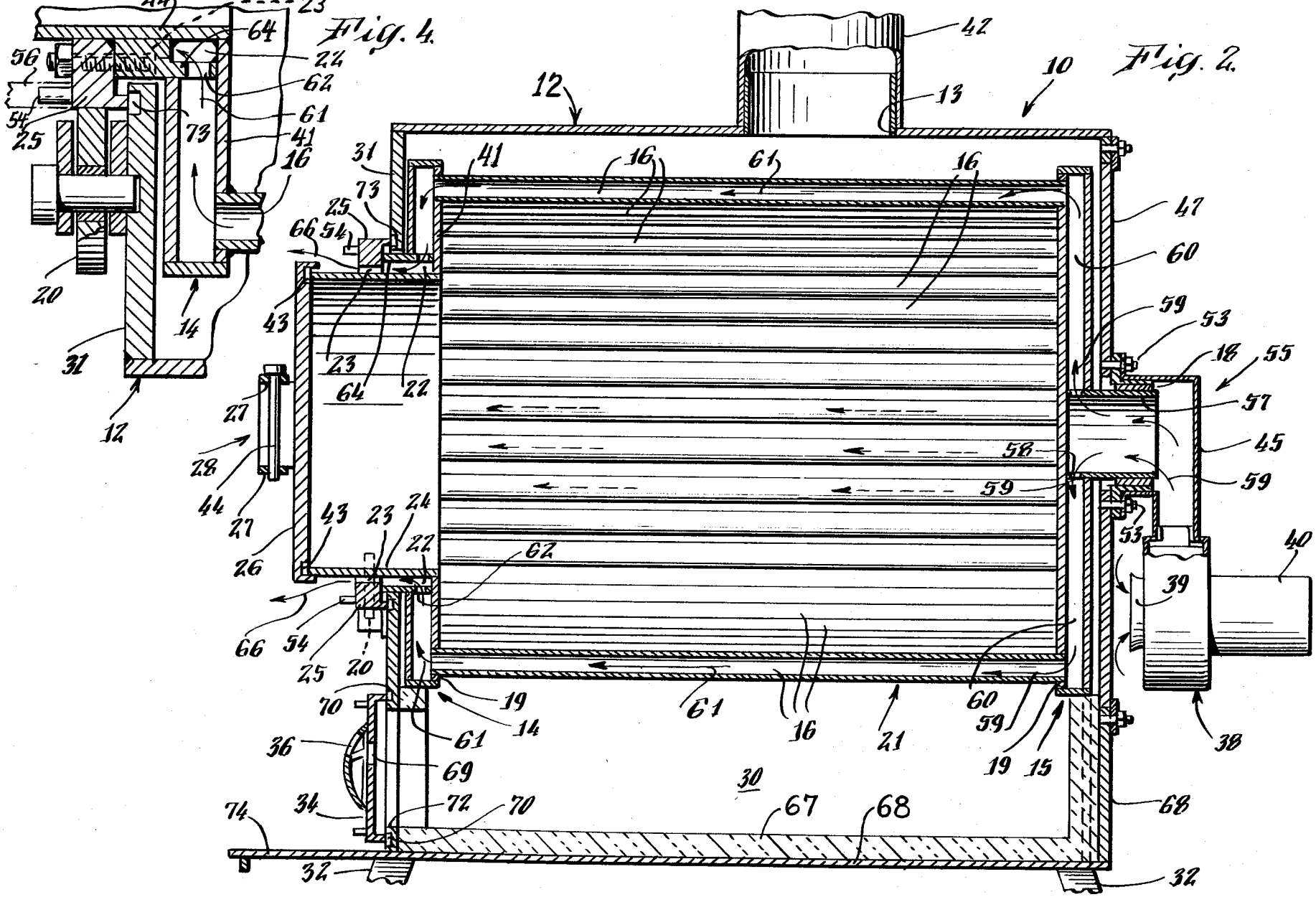
FIG. 2 is a side elevational sectional view of the wood and coal stove taken along line 2—2 in FIG. 1.
FIG. 4 is a partial cross-sectional view showing details of the rotatable supporting arrangement of the squirrel-cage within the wood or coal stove, being a view taken along the line 4—4 in FIG. 1.

FIG. 1 shows a front view of the stove 10 having a substantially cylindrical housing 12 with a flue outlet 13 at the top and a front annular air tube support header 14 mounted within the housing. This annular header 14 holds the front ends of a plurality of uniformly spaced, cylindrically arranged parallel air tubes 16. These air tubes 16 extend longitudinally from the front toward the back of the stove 10 through a combustion chamber 17 and are held in place at the rear of the stove by rear hollow disk-like air-tube support header 15, supported by a rear bearing 18 as best seen in FIG. 2. The air conducting pipes or tubes 16 are welded or swaged at 19 into holes in the respective hollow annular header 14 and hollow disk-like header 15, thereby forming a rigid squirrel-cage structure 21.

The annular header 14 of this cage assembly of air tubes 16 is borne by two rollers 20, one of which is seen in detail in FIG. 4. These two rollers 20 are rotatably mounted on the front of the stove ahead of the combustion chamber 17 and behind and below a fuel-load door 26.

This fuel-load door 26 is supported on a hinged clamp 28 including a pair of parallel horizontal bars 27 joined by vertical angle irons 29 which extend between and are welded to the bars 27.

At the left of the door 26 as seen in FIG. 1, the support clamp 28 is hinged to the front face 31 of the cylindrical housing 12. There are a pair of vertically spaced forwardly extending brackets 33 welded onto the housing front face 31. A hinge tube 35 is attached to the left end of the door clamp 28, and a hinge pin 37 extends through these brackets 33 and through the tube 35 for allowing the door clamp 28 and door 26 to swing forward away from a cylindrical fuel-loading entry 24 which extends forward a short distance ahead of housing front face 31. This round cylindrical fuel-loading entry 24 is welded to a rear ring portion 41 (FIG. 2) of the annular header 14, and thus the entry 24 is rotatable integral with the squirrel-cage assembly 21. It is this round entry 24 which has an encircling ring rail 25 secured thereto which rolls on the two support rollers 20.

A center pin 44 hinges the door 26 to its support clamp 28 . The entire door 26 swings open on its hinge 35, 37, and the door is clamped shut by a dog 48 hinged at 49 to the front face 31 on the side opposite the hinge 35, 37. This dog 48 has a rotatable screw-down handle 51, and the articulated door assembly 26, 28 with its center hinge pin 44 enables an effectively air-tight seal to be made by ring gasket 43 (FIG. 2) at the junction of the door 26 and the rotatable entry 24. This air-tight seal gasket 43 is made of heat resistant and wear resistant material, for example of ceramic or metal fibers and prevents an uncontrolled flow of air to the combustion chamber 17, thereby enabling the user to effectively and efficiently control the amount of air flowing into the combustion chamber as will be explained.

As discussed above, the assembled array of air tubes 16 form a squirrel-cage grate 21 which is adapted to hold wood or coal fuel loaded through the entry 24 behind the door 26. As the fuel burns within this cylindrical combustion chamber 17 enclosed by the cage 21 of air tubes 16, cold air from outside of the stove 10 is drawn into a cold air intake 39 of a blower 38 driven by an electric motor 40. This blower 38 has a discharge duct 45 connected by studs and nuts 53 to the rear face 47 of the housing 12. The rear bearing 18 is seated in a connection assembly 55, where the duct 45 is connected to the rear face 47 of the housing 12. The rotatable disk-like header 15 at the rear of the grate cage 21 has an axial duct 57 welded thereto and extending rearwardly, being journaled for rotation within the rear bearing 18. This axial duct 57 includes a plurality of radial ports 58 opening out into the hollow interior 60 of the header 15.

Consequently, the blower 38 forces room air 59 through its discharge duct 45 into the axial duct 57 and thence out through the ports 58 into the hollow interior 60 of the rotatable header 15. This cool room air 59 enters the rear of the air tubes 16 and flows forwardly through them producing heated air 61 which enters the annular header 14. This heated air 61 blows radially inwardly through axial ports 62 (FIG. 4) in a cylindrical collar 64 encircling the entry 24 and radially spaced outwardly from this entry for forming an exit channel 22 for the heated air 61. The ring rail 25 includes multiple orifices 23 for directing the heated air 61 forwardly as shown by arrows 66 (FIG. 2) from channel 22 into the room. In this way, space heating is accomplished with the present stove by both radiation of heat from the exterior housing 12 and by donduction and convection of forced hot air 61, 66. The air heating tubes 16 effectively at least double the surface area available for heat exchange and thereby considerably enhance the efficiency of this stove.

As the fuel supported by the air tubes 16 burns, ashes fall down through the spaces between them into an ash chamber 30 which is located at the bottom of the stove 10. The stove as a whole is supported by legs 32 (FIG. 1). A generally rectangular longitudinally extending lower housing portion 68 defines the ash chamber 30. As seen in FIG. 1, the round cylindrical top portion of the housing 12 plus this lower portion 68, gives an overall keyhole shape to the stove 10 as seen in front elevation. The ash chamber housing 68 is lined with fire brick 67 on the bottom and sides to retain interior heat and protect the metal housing 68.

Access to the ash chamber 30 is provided through an ash chamber door 34 which carries a hemispherical cap 36 associated with air intake ports 69 for controlling the combustion draft to be established into combustion chamber 17, with the combustion gases going up through chimney flue 42. These ports 69 are adjusted by rotating the hemispherical body of the cap 36 about its central threaded stud which projects forward from the ash chamber door 34. Similar to the larger fuel-load door 26 provided above, the ash chamber door 34 engages a substantially air-tight gasket 70 and is mounted on the front of the stove by a hinge pin mounting 50 at the left and is closed tight by a locking dog 52 at the right. This door 34 when opened gives access to an ash pit doorway 72 which is provided in the front of the lower housing portion 68. There is a front "porch" or ledge 74 extending forward below the ash pit doorway 72 for facilitating handling of ashes.

Figure 3:
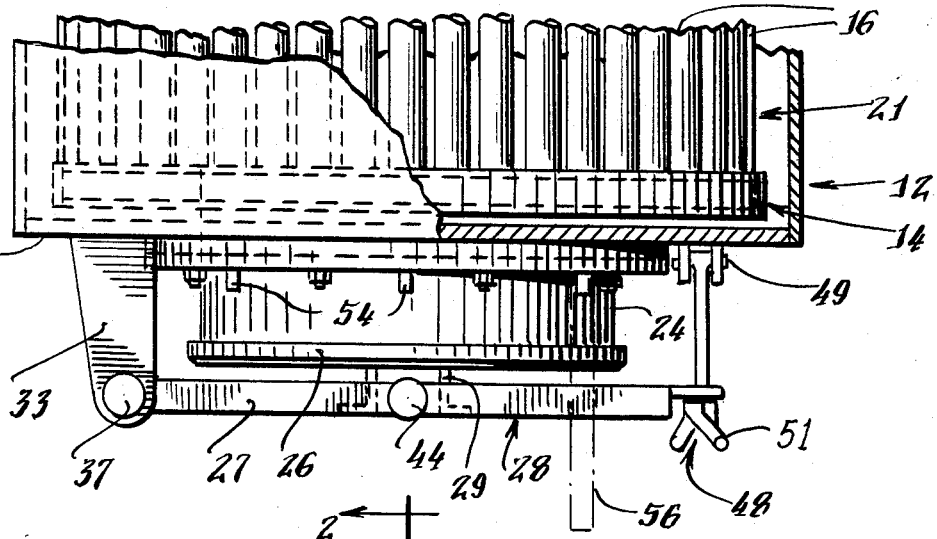
FIG. 3 is a top cut away view of the front of the coal or wood stove.

FIG. 3 illustrates the means of operation of the stove. Once fuel within the grate of air tubes 16 has burned for some time, a hollow rod-like handle 56 (FIGS. 3 and 4) is manually placed onto any one of the conveniently disposed rotation lugs 54 on the front of the ring rail 25 (see FIG. 2) whose longitudinal axes are parallel to that of the stove. After the handle 56 is engaged on a lug 54, the user employs this handle for rotating the entire cage-like assembly 21, which includesthe ring rail or ring track 25, entry 24, front annular header 14, air tubes 16, rear disk header 15 and rear axial duct 57. This entire squirrel-cage assembly rotates as a unit on the rear bearing 18 and on the two front rollers 20. The ring rail 25 includes a rearwardly projecting annular lip (FIG. 4) which is in sliding sealing engagement against a wear-resistant gasket 73 mounted in a groove in the front face plate 31 of the housing 12.

The user turns the tube cage assembly 21 by means of the handle 56 when the fuel-loading door 26 is open at the time of inserting additional fuel. Thus, the door gasket 43 is away from the fuel-loading entry 24 at the time of rotating the tube assembly 21. This rotation causes hot air tubes which were beneath the burning fuel at the bottom of the combustion chamber 17 to be moved by an eighth to a quarter turn, progressing eventually around toward the top of the cylindrical cage 21. These newly uppermost hot air tubes become cooled by air flow 59, 61 and now serve as cooled condensation surfaces for creosote vapors which rise from the flames up toward the flue or chimney 42.

At the time of the next re-filling with fuel, the user again turns the tube case assembly 21 by an incremental amount, for example an eighth to a quarter turn. The most convenient operation is to turn by the distance from one lug 54 to the next. In this embodiment there are eight lugs for providing a one-eighth increment of turning from one lug to the next one. Thus, the individual tubes which were farthest from the burning fuel on which creosote was deposited eventually become returned to the lower region in the combustion chamber 17 beneath the hot coals of fuel. Being closest to the hottest region in the chamber, the creosote is then burned off from these tubes. Thus, advantageously much of the heat energy of the creosote is usefully obtained, rather than going up into the flue 42. Some portion of this creosote will be volatilized and will recondense on other cool air tubes to be burned later. Most of the unwanted formation of dangerous creosote however, will be burned off from the air tubes by revolving them into position near the hot coals of the fire. The cool air tubes further act as condensing shields for the upper area of the inside of the housing and for the flue and chimney. They screen these regions from creosote condensation therein. By continuing to periodically rotate the cage assembly 21, the user provides an automatically self-cleaning action in this wood or coal stove which has improved, efficient heat exchange capability.

In order to provide access to the tube cage assembly 21 for cleaning or scraping the air-conducting grate tubes 16, there is a removable access door 76 sealed to the housing 12 by a gasket 78, as shown in FIG. 1.

Although the invention has been described with reference to a particular embodiment, it is to be understood that various changes and modifications may be made in the stove without departing from the spirit and scope of this invention as defined in the following claims and reasonable equivalents of the claimed elements.

What is claimed is:

1. The method of burning wood or coal fuel in a home-heating stove comprising the steps of:

providing a rotatable, squirrel-cage grate of spaced parallel rigid tubes arranged in a continuous circular cylindrical squirrel-cage configuration, rotatably mounting said grate for rotation about a generally horizontal axis within a stove housing having a flue for exit of combustion gases, providing an accessible fuel-loading opening at one axial end of said cylindrical squirrel-cage grate, loading fuel into said rotatable grate through said fuel-loading opening at the axial end of said grate, burning the fuel in said grate with the gaseous products of combustion passing out of the housing through the flue, blowing room air through all of said air tubes for heating the room air and for cooling all of the tubes and for condensing creosote on the cooled tubes which happen to be near the top of the grate, and periodically rotating said grate through a portion of a full revolution during combustion of the fuel for moving the creosote-coated tubes down toward the bottom of the grate where combustion is occurring for burning the creosote off from the tubes for obtaining the heat value of the burned creosote and also for reducing the accumulation of creosote in the flue.

2. The method of burning wood or coal fuel in a home heating stove as claimed in claim 1 wherein:

said grate is periodically rotated through a portion of a full revolution in the range from one eighth to one fourth of a full revolution.

3. The method of burning wood or coal fuel in a home heating stove as claimed in claim 2, wherein:

said grate is rotated each time that fuel is loaded into said rotatable grate.

4. The method of burning wood or coal fuel in a home heating stove as claimed in claim 1, wherein:

said grate is rotated each time that fuel is loaded into said rotatable grate.

5. A home-heating stove for burning wood or coal fuel comprising:

a housing having at least one adjustable inlet port near the bottom for admitting combustion air and a flue outlet near the top for carrying off the gaseous products of combustion, a rotatable squirrel-cage grate of spaced air tubes having a fuel-loading opening at one axial end for loading fuel into said grate for burning therein, bearing means for rotatably supporting said squirrel-cage grate within said housing for rotation about a generally horizontal axis of rotation aligned with the axis of symmetry of said grate, blower means for propelling room air, air conducting means defining an air path for coupling said blower means to said air tubes for blowing room air through said tubes for heating the air and for cooling the tubes of said grate, further air conducting means defining an air path from the tubes into the room for discharging the heated air into the room, and means for periodically rotating said grate through a portion of a full revolution about its axis to a changed position as combustion is occurring.

6. A home-heating stove for burning wood or coal fuel comprising:

a housing having at least one adjustable inlet port near the bottom for admitting combustion air and a flue outlet near the top for carrying off the gaseous products of combustion, a rotatable squirrel-cage grate of spaced tubes having a fuel-loading opening at one axial end for loading fuel into said grate for burning therein, bearing means for rotatably supporting said squirrel-cage grate within said housing for rotation about a generally horizontal axis of rotation aligned with the axis of symmetry of said grate, said squirrel-cage grate having a rotatable annular header encircling said fuel-loading opening and being secured to said air tubes for supporting them, rotatable support means carried by the housing for supporting said annular header in rotatable relationship with respect to the housing, blower means for propelling room air, air conducting means defining an air path for coupling said blower means to said air tubes for blowing room air through said tubes for heating the air and for cooling the tubes of said grate, further air conducting means defining an air path from the tubes into the room for discharging the heated air into the room, and means for periodically rotating said grate through a portion of a full revolution about its axis to a changed position as combustion is occurring.

7. A home-heating stove as claimed in claim 6, in which:

said annular header is connected to a ring-like track encircling said fuel-loading opening, and said rotatable support means are in rolling engagement with said ring-like track.

8. A home-heating stove as claimed in claim 7, in which:

said means for periodically rotating said grate includes a plurality of elements mounted on said ring-like track and being spaced about the axis of rotation for defining a plurality of attachment locations at each of which a manually operable handle is releasably attachable.

9. A home-heating stove as claimed in claim 6, in which:

said fuel-loading opening includes a circular cylindrical entry member concentric with the axis of rotation and being secured to said annular header, said cylindrical entry member projecting from one axial end of the grate, and openable door means for closing said entry member.

10. A home-heating stove as claimed in claim 9, in which:

said rotatable support means includes a ring-like track encircling said entry member, and rolling support means engaging said track in rolling engagement therewith.

11. A home-heating stove for burning wood or coal fuel comprising:

a housing having at least one adjustable inlet port near the bottom for admitting combustion air and a flue outlet near the top for carrying off the gaseous products of combustion, a rotatable squirrel-cage grate of spaced air tubes having a fuel-loading opening at one axial end for loading fuel into said grate for burning therein, bearing means for rotatably supporting said squirrel-cage grate within said housing for rotation about a generally horizontal axis of rotation aligned with the axis of symmetry of said grate, blower means for propelling room air, air conducting means defining an air path for coupling said blower means to said air tubes for blowing room air through said tubes for heating the air and for cooling the tubes of said grate, further air conducting means defining an air path from the tubes into the room for discharging the heated air into the room, and said further air conducting means including an annular header encircling said fuel-loading opening and being secured to said tubes in air-conducting relationship, said annular header being rotatable with said grate, said fuel-loading opening including a circular cylindrical entry member concentric with the axis of rotation and being secured to said annular header for rotation with said grate, said cylindrical entry member projecting from one axial end of the grate, openable door means for closing said entry member, rotatable support means carried by the housing for supporting said annular header in rotatable relationship with respect to said housing, and means for periodically rotating said grate through a portion of a full revolution about its axis to a changed position as combustion is occurring.

12. A home-heating stove as claimed in claim 11, in which:

said entry member includes a track encircling said entry member, and said rotatable support means engages said track in rolling relationship for rotatable supporting said entry member which, in turn, supports said annular header.

13. A home-heating stove as claimed in claim 12, in which:

said means for periodically rotating said grate includes a plurality of elements mounted on said ring-like track and being spaced about the axis of rotation for defining a plurality of attachment locations at each of which a manually operable handle is releasably attachable.

14. A home-heating stove for burning wood or coal fuel comprising:

a housing having at least one adjustable inlet port near the bottom for admitting combustion air and a flue outlet near the top for carrying off the gaseous products of combustion, a rotatable squirrel-cage grate of spaced air tubes having a fuel-loading opening at one axial end for loading fuel into said grate for burning therein, bearing means for rotatable supporting said squirrel-cage grate within said housing for rotation about a generally horizontal axis of rotation aligned with the axis of symmetry of said grate, blower means for propelling room air, air conducting means defining an air path for coupling said blower means to said air tubes for blowing room air through said tubes heating the air and for cooling the tubes of said grate, further air conducting means defining an air path from the tubes into the room for discharging the heated air into the room, and means for periodically rotating said grate through a portion of a full revolution about its axis to a changed position as combustion is occurring, said means for periodically rotating said grate including a plurality of elements mechanically connected to said grate and being spaced about the axis of rotation for deining a plurality of attachment locations at each of which a manually operable handle is releasably attachable.

15. A home-heating stove for burning wood or coal fuel comprising:

a housing having at least one adjustable inlet port near the bottom for admitting combustion air and a flue outlet near the top carrying off the gaseous products of combustion, a rotatable squirrel-cage grate of spaced air tubes having a fuel-loading opening at one axial end for loading fuel into said grate for burning therein, bearing means for rotatably supporting said squirrel-cage grate within said housing for rotation about a generally horizontal axis of rotation aligned with the axis of symmetry of said grate, blower means for propelling room air, air conducting means defining an air path for coupling said blower means to said air tube for blowing room air through said tubes for heating the air and for cooling the tubes of said grate, said air conducting means including a disc-like header positioned at the opposite end of said grate from said fuel-loading opening, said disc-like header being secured to said tubes in air conducting relationship, said disc-like header rotating integrally with said grate, coupled to said disc-like header concentric with the axis of rotation for carrying blower-propelled room air into said disc-like header, further air conducting means defining an air path from the tubes into the room for discharging the heated air into the room, and means for periodically rotating said grate through a portion of a full revolution about its axis to a changed position as combustion is occurring.

16. A home-heating stove for burning wood or coal fuel comprising:

a housing having at least one adjustable inlet port near the bottom for admitting combustion air and a flue outlet near the top for carrying off the gaseous products of combustion, a rotatable squirrel-cage grate of air tubes said grate having a fuel-loading opening at one axial end for loading fuel into said grate for burning therein, bearing means for rotatably supporting said squirrel-cage grate within said housing for rotation about a generally horizontal axis of rotation concentric with the axis of symmetry of said grate, a disc-like header secured to said tubes in air-conducting relationship, said disc-like header being positioned at the opposite end of said grate from said fuel-loading opening, said disc-like header rotating integrally with said grate, blower means for propelling room air, coupling means coupled to said disc-like header concentric with the axis of rotation and being in air conducting relationship with said blower means for carrying the blower-propelled room air into said disc-like header and thence into said tubes for heating the room air while cooling the tubes, an annular header encircling said fuel-loading opening and being secured to said tubes in air conducting relationship for receiving heated air from said tubes, air conducting means connected to said annular header for feeding the heated air from the stove into a room, and means for periodically turning said grate about its axis of rotation as combustion is occurring.

17. A home-heating stove as claimed in claim 16,in which:

a cylindrical entry member concentric with the axis of rotation is secured to said annular header, said entry member projects axially from the fuel-loading end of the grate, said entry member rotates integrally with the grate, openable door means for closing said entry member.

18. A home-heating stove as claimed in claim 17, in which:

a ring track is mounted on said entry member concentric with the axis of rotation, and said bearing means includes rolling means carried by said housing in rolling engagement with said ring track.

19. A home-heating stove as claimed in claim 18, in which:

said means for periodically turning said grate includes a plurality of elements mounted upon said ring track and spaced about the axis of rotation for defining a plurality of attachment locations at each of which a manually operable handle is releasably attachable for manually turning said grate.

20. A home-heating stove as claimed in claim 18, in which:

said air conducting means connected to said annular header for feeding heated air into the room carries the heated air around said entry member and beneath the perimeter of said ring track.

21. A home-heating stove as claimed in claim 19, in which:

said air conducting means connected to said annular header for feeding heated air into the room carries the heated air around said entry member and beneath the perimeter of said ring track.

* * * * *